United States Patent [19]

Wilson

[11] 4,419,839

[45] Dec. 13, 1983

[54] CHARGE CONTAINER FOR FIREARMS

[76] Inventor: Hugh R. Wilson, 10840 SW. 120th St., Miami, Fla. 33176

[21] Appl. No.: 359,746

[22] Filed: Mar. 19, 1982

[51] Int. Cl.[3] ..... F42B 39/04; F41C 27/00

[52] U.S. Cl. ..... 42/90

[58] Field of Search ..... 42/90

[56] References Cited

U.S. PATENT DOCUMENTS

| | | | |
|---|---|---|---|
| 4,112,606 | 9/1978 | Griffin | 42/90 |
| 4,123,868 | 11/1978 | Wilson | 42/90 |
| 4,135,322 | 1/1979 | Tice et al. | 42/90 |
| 4,205,475 | 6/1980 | Wilson | 42/90 |
| 4,207,698 | 6/1980 | Burson | 42/90 |

*Primary Examiner*—Charles T. Jordan

[57] ABSTRACT

The invention is a projectile holding sleeve that is open at both ends and mounted on the body of a container having a chamber for containing a propellant powder charge and a closure lid having a capholder for holding a percussion cap. The sleeve, being open at both ends allows a bullet starter or ramrod to pass through for rapid transferral of the projectile from the sleeve to the bore of a muzzleloading firearm.

2 Claims, 7 Drawing Figures

CHARGE CONTAINER FOR FIREARMS

FIELD OF THE INVENTION

The device is intended for use with muzzleloading firearms for hunting and for target shooting.

DESCRIPTION OF THE PRIOR ART

Although a number of different charge containing devices have appeared over the years, each one usually has a major or minor feature in construction that presents a problem when the device is put to use. This novel improvement allows all components of the loading charge to be quickly availabe to the user but at the same time keeps each component separated from the others. Unlike the device shown in U.S. Pat. No. 4,123,868 in which the projectile is used as a closure and comes into direct contact with the powder charge, this novel device keeps the projectile separated from the powder charge and eliminates the possibility of any particles of powder adhering to the projectile. The same advantage is present when used with a round ball and a greased patch. Although the several charge components are separated from each other, each may transferred directly to the firearm without being touched by the hands of the user and as a result, both the hands of the user and the charge components remain free of soiling or contamination. The combination of features described herein are not found in the prior art and represent a novel and useful departure from the prior art.

SUMMARY OF THE INVENTION

It is an object of this invention to provide a new and novel charge container that will keep all load components separated from each other to avoid contamination.

It is a further object of this invention to provide a charge container that while the components are separated from each other, the components may transferred directly to a muzzleloading firearm in a rapid and precise manner.

It is still another object of this invention to provide a charge container that is compact and very easy to use.

A BRIEF DESCRIPTION OF THE DRAWINGS

DESCRIPTION OF THE PREFERRED EMBODIMENT

Figure 1:
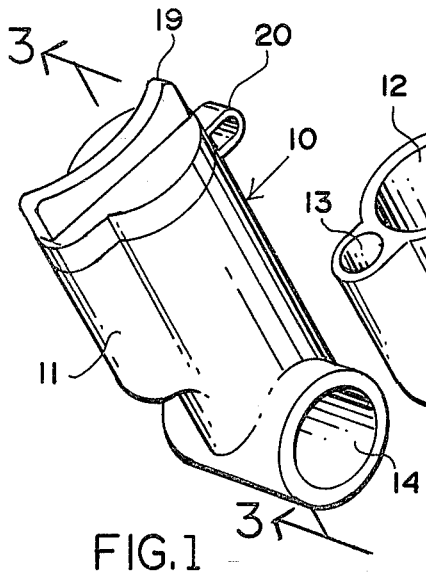
FIG. 1 is a perspective view of the device with the lid in the closed position.
Figure 2:
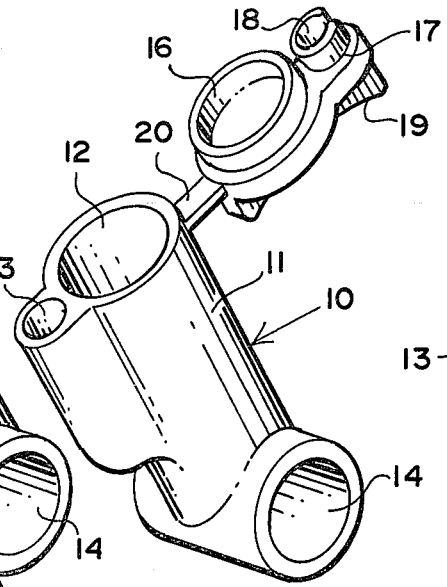
FIG. 2 is a perspective view of the device with the lid in the opened position.
Figure 3:
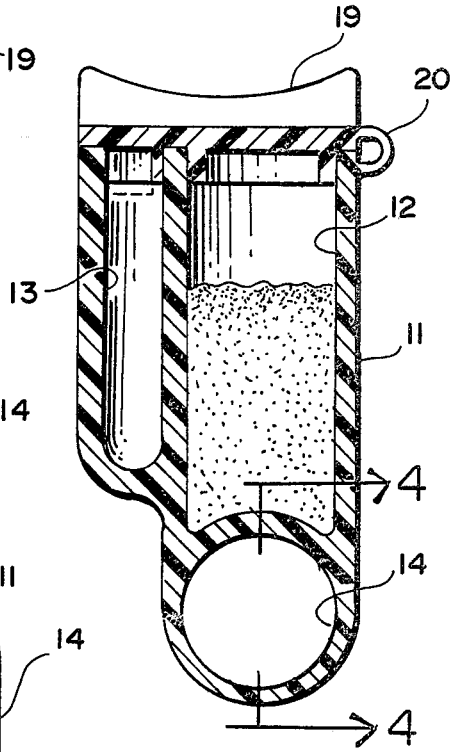
FIG. 3 is a cross sectional view of the device.
Figure 4:
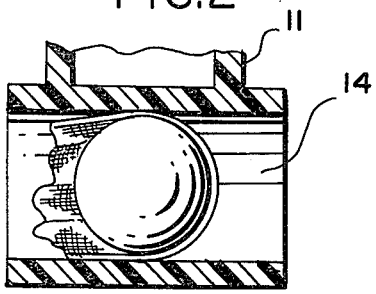
FIG. 4 is a cross sectional view of the projectile holding sleeve with a round ball and cloth patch contained therein.

Referring to the drawings by characters of reference, FIGS. 1–4 illustrate a charge container for use with firearms. the container 10 is constructed of a plastic material. The upper part of the body 11 has the chamber 12 for containing a charge of gunpowder and the chamber 13 for enclosing the capholder 17 together with a percussion cap. The lid 19 is provided to seal the gunpowder and percussion cap from wetness and contamination with seal 16 and the capholder 17 engaging the walls of the chambers 12 and 13 when the lid 19 is moved to a closed position. The lower part of the container 10 is provided with the hollow sleeve 14 for holding a projectile. The projectile is separated from the gunpowder charge contained in the chamber 12 by the wall of the sleeve 14. A fresh percussion cap is held in the socket 18 of the capholder 17. The hinge strap 20 is provided to avoid loss of the lid 19 when the lid is in the opened position.

Figure 5:
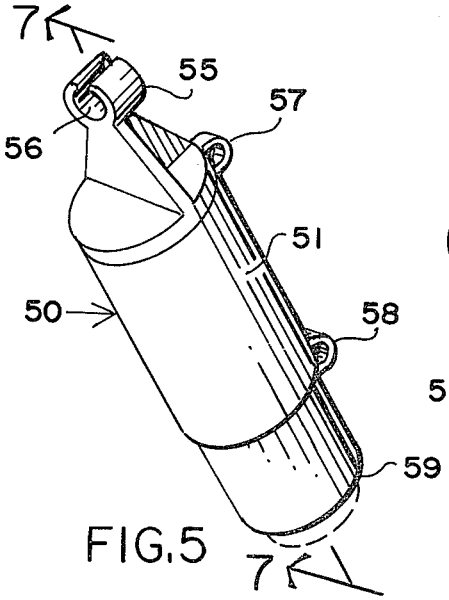
FIG. 5 shows an alternate variation of the device with the lid and sleeve in the closed position.
Figure 6:
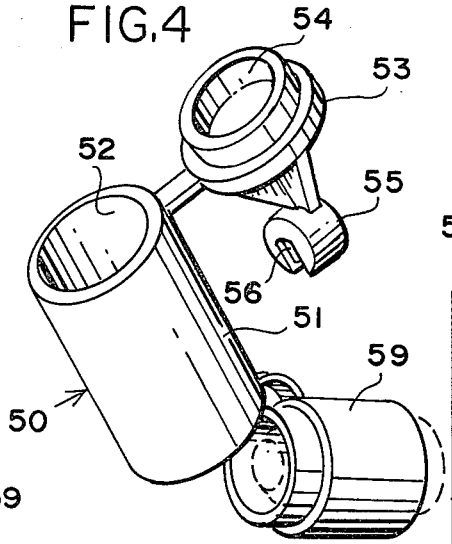
FIG. 6 is a perspective view of the variation with the lid and sleeve in the opened position, the projectile contained in the sleeve shown in broken lines.
Figure 7:
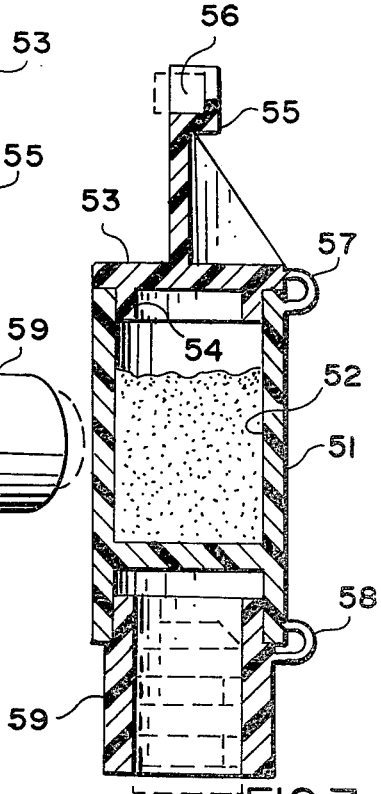
FIG. 7 is a cross sectional view showing the device with the lid and sleeve in the closed position, a percussion cap, powder charge and a projectile shown in broken lines.

FIGS. 5–7 illustrate an alternate variation of the device. The container 50 is constructed of a plastic material. The upper part of the container body 51 is provided with the chamber 52 for containing a charge of gunpowder. The lid 53 is to seal the chamber 52 against contamination with the seal 54 fitting securely into the chamber 52. The lid 53 is provided with the capholder 55 which includes the socket 56 for holding a percussion cap. A hinge strap 57 prevents loss of the lid 53 when the lid is in an opened position. The hollow sleeve 59 is provided for holding a projectile in readiness, the sleeve 58 being attached to the body 51 by the hinge strap 58.

OPERATION OF THE DEVICE

To use the device shown in FIGS. 1–4, the lid 19 is placed in the opened position. A measured powder charge is then placed in the chamber 12 and a fresh percussion cap is inserted into the socket 18 of the capholder 17. The lid 19 is then moved to the closed position. A projectile is placed in the sleeve 14 and the container is ready for use. To transfer the charge to a muzzle-loading firearm, the lid 19 is forced open with the tip of the user's thumb and the powder charge is poured from the chamber 12 into the open end of the rifle barrel. The open end of the sleeve 14 is then placed over the bore of the rifle barrel and the projectile is pushed from the sleeve 14 into the bore of the firearm with a bullet starter or a ramrod. The percussion cap held in the socket 18 of the capholder 17 is then placed over the breech nipple of the firearm. The lid 19 is then pulled away leaving the percussion cap on the nipple and the firearm is ready for use.

With the alternate device shown in FIGS. 5–7, the lid 53 is placed in the opened position, the gunpowder charge is placed into the chamber 52, the lid 53 is closed and a fresh percussion cap is placed in the socket 56 of the capholder 55. A projectile is placed in the sleeve 59 and the sleeve 59 is pushed into position into the lower end of the container body 51. The container is then ready for use.

To transfer the loading into a muzzleloading firearm, the lid 53 is forced open with the tip of the user's thumb. The powder charge contained in the chamber 52 is poured into the open bore of a firearm, the sleeve 59 is pushed away from the container body 51, the open end of sleeve 59 is placed over the bore of the firearm and the projectile is pushed from the sleeve 59 into the bore of the firearm. The percussion cap held in the capholder 55 is then placed over the breech nipple of the firearm and secured which completes the loading procedure.

Although but a few embodiments of the invention have been shown and described, it will be apparent to those skilled in the art that changes and modifications may be made therein without departing from the spirit of the invention or from the scope of the appended claims.

I claim:

1. In a charge container for use with muzzle loading firearms, said container having a body, said body having chamber means for containing at least one charge component, said chamber means being open at only one side, all other sides of said chamber means being closed, closure means for closing said open side of said chamber means, cap holding means mounted on said closure means for holding a percussion cap, the combination with said body, said chamber means, said closure means and said cap holding means, of projectile holding means, said projectile holding means being mounted on said body and against a closed side of said chamber means, said projectile holding means being substantially of a tubular configuration, for holding a projectile therein, and being open at both ends to allow a bullet starter or ramrod to operate through said projectile holding means for rapid transferral of a projectile to the bore of the firearm.

2. Apparatus as set forth in claim 1 wherein said container is made of a plastic material.

* * * * *